United States Patent [19]

Patton

[11] Patent Number: 5,015,587

[45] Date of Patent: May 14, 1991

[54] REFORMER OPTIMIZATION FOR HEAD LIMITED RECYCLE SYSTEM

[75] Inventor: Gary R. Patton, Borger, Tex.

[73] Assignee: Phillips Petroleum Company, Bartlesville, Okla.

[21] Appl. No.: 230,009

[22] Filed: Aug. 8, 1988

[51] Int. Cl.[5] ..... G01N 35/00

[52] U.S. Cl. ..... 436/55; 196/132; 208/361; 422/110; 422/111

[58] Field of Search ..... 436/55; 208/100, 361; 196/132; 422/110, 111

[56] References Cited

U.S. PATENT DOCUMENTS 2,849,379 8/1958 Hengstebeck ..... 422/189 X
4,695,364 9/1987 Graziani et al. ..... 208/59

OTHER PUBLICATIONS

Encyclopedia of Chemical Processing and Design, Marcel Dekker, Inc., 1978, pp. 1-15, 42-43, 75-79, 80-84, 100-114 and 466-472.

Encyclopedia of Chemical Technology, John Wiley & Sons, Inc., 1982, vol. 17, pp. 201-209 and 218-220.

Clark Compressor Catalog, Clark Manufacturing Company, pp. 5-1-5-13.

Instrument Engineers' Handbook, vol. 2-Process Control, Belag Liptak, Editor, Chilton Book Company, p. 1526.

*Primary Examiner*—Robert J. Warden
*Assistant Examiner*—Amalia L. Santiago
*Attorney, Agent, or Firm*—Laney, Dougherty, Hessin & Beavers

[57] ABSTRACT

A reformer optimization system including the injection of non-reactive gas into hydrogen recycle gas for increasing hydrogen flow through a recycle compressor. Non-reactive gas is injected into hydrogen-rich gas fed to the compressor at least as early as the hydrogen-rich gas enters the compressor. The quantity of hydrogen is monitored, and the quantity of non-reactive gas injected is controlled in response to the hydrogen quantity. By maintaining a substantially constant molecular weight of the hydrogen gas, hydrogen content thereof is increased. The non-reactive gas is preferably at least one of a group comprising nitrogen, ethane and propane.

12 Claims, 3 Drawing Sheets

REFORMER OPTIMIZATION FOR HEAD LIMITED RECYCLE SYSTEM

BACKGROUND OF THE INVENTION

1. Field Of The Invention

This invention relates to the operation of reformer centrifugal compressors, and more particularly, to improvement in such an operation comprising the injection of nonreactive gas to maintain a substantially constant molecular weight of the recycled gas and thereby increase hydrogen content thereof.

2. Description Of The Prior Art

Catalytic reforming is a process performed to increase the octane number of naphtha. That is, it is done to increase the gasoline yield from crude oil. This is particularly important today since the elimination of lead in gasoline has resulted in a loss in octane. Recycled hydrogen is fed into a naphtha feed by a compressor, and the mixed feed is charged to a reforming reactor or a series of such reactors in which the mixture of hydrogen and charge vapors is contacted with a reforming catalyst. Either fixed bed or fluidized bed systems may be used. The effluent from the reforming reaction is usually cooled and partly condensed in a flash or separator drum. Condensed fluids or reformate are withdrawn from the drum and further processed as desired. Hydrogen-rich tail gas from the separator drum may be used for hydrogen services or fed back to the recycle compressor.

It is desirable to maximize the hydrogen flow through the compressor, because the reforming catalyst life is very dependent on the hydrogen-to-hydrocarbon recycle ratio. The normal metal catalysts lose activity in the presence of sulphur and nitrogen compounds and are poisoned by metals such as arsenic and lead. Hydrogen fed into the feed, or hydrotreating, removes the nitrogen, sulphur, oxygen and metals, and this helps protect and improve the performance of the catalyst. The advantage of the reforming process is that large quantities of net hydrogen are produced which greatly facilitates the hydrotreating. In addition, hydrotreating of the feed also improves the yield and quality of the reformate and increases the time between regenerations.

The compressors normally used are of the centrifugal type. A problem is that the recycle rate drops as the molecular weight of the recycled gas drops. In other words, by increasing the hydrogen content, the recycle rate will drop because the hydrogen reduces the molecular weight of the recycled gas. To compensate with a centrifugal compressor is a problem because, while the capacity is directly proportional to speed, the head is proportional to the square of the speed, and the brake horsepower is proportional to the cube of the speed, as is well known. Further, the compressor has an overall head limitation, so by increasing speed to increase capacity, the head limitation is reached much more quickly than the desired capacity. Larger compressors with larger drivers could be used, of course, but this may not be cost effective.

One attempt to solve this, problem is disclosed in U.S. Pat. No. 2,849,379 to Hengstebeck. In this patent, control of the recycle compressor is exercised by maintaining compressor speed substantially constant at a constant discharge pressure by controlling the temperature in the flash zone so as to maintain the molecular weight of the recycle gas substantially constant while maintaining the pressure drop of the gas through a flow control orifice constant. The flow of recycled gas from the compressor is controlled by a flow controller which may take the form of a conventional orifice meter and a controller which controls the compressor speed. A second controller monitors compressor speed and controls the flow of cooling water through a cooler through which the gas is fed to the flash drum.

The present invention increases the hydrogen recycle and catalyst life by the injection of non-reactive gas into the hydrogen recycled gas fed to the compressor. The complicated control system of the Hengstebeck patent is not needed.

SUMMARY OF THE INVENTION

The catalytic reforming system of the present invention comprises a recycle compressor for recycling hydrogen-rich gas into a naphtha feed and means for injecting a nonreactive gas into the hydrogen-rich gas at least as early as the hydrogen-rich gas enters the compressor. Generally, the non-reactive gas is injected upstream of the compressor. The compressor is preferably a centrifugal compressor.

The system further comprises monitoring means for monitoring a quantity of hydrogen in the hydrogen-rich gas and controlling means for controlling a quantity of the nonreactive gas injected into the hydrogen-rich gas.

The invention also includes a method of increasing hydrogen flow through a reformer recycle compressor and comprising the steps of feeding a stream of hydrogen to the compressor and injecting non-reactive gas into the hydrogen stream. The method may also comprise monitoring a quantity of hydrogen in the hydrogen stream on an upstream side of the compressor, preferably prior to the injecting of the non-reactive gas. The method also comprises the step of maintaining a substantially constant molecular weight of the mixture of hydrogen and non-reactive gas. The quantity of non-reactive gas is preferably relatively smaller than the quantity of hydrogen in the hydrogen stream.

Stated in another way, the invention includes an improvement in a reformer centrifugal compressor operation comprising injecting non-reactive gas into hydrogen recycle gas for maintaining substantially constant molecular weight of the gas mixture and thereby increasing hydrogen recycle. The injecting of the non-reactive gas is controlled in response to a hydrogen content of the hydrogen recycle gas.

The non-reactive gas is preferably at least one of a group comprising nitrogen, ethane and propane.

An important object of the invention is to provide a catalytic reforming system with means for injecting a nonreactive gas into a hydrogen-rich gas stream entering a compressor.

Another object of the invention is to provide a method increasing hydrogen recycle through a reformer compressor by injecting non-reactive gas into the hydrogen recycle gas.

Additional objects and advantages of the invention will become apparent as the following detailed description of the preferred embodiment is read in conjunction with the examples and drawings which illustrate such preferred embodiment.

DESCRIPTION OF THE PREFERRED EMBODIMENT

Figure 1:
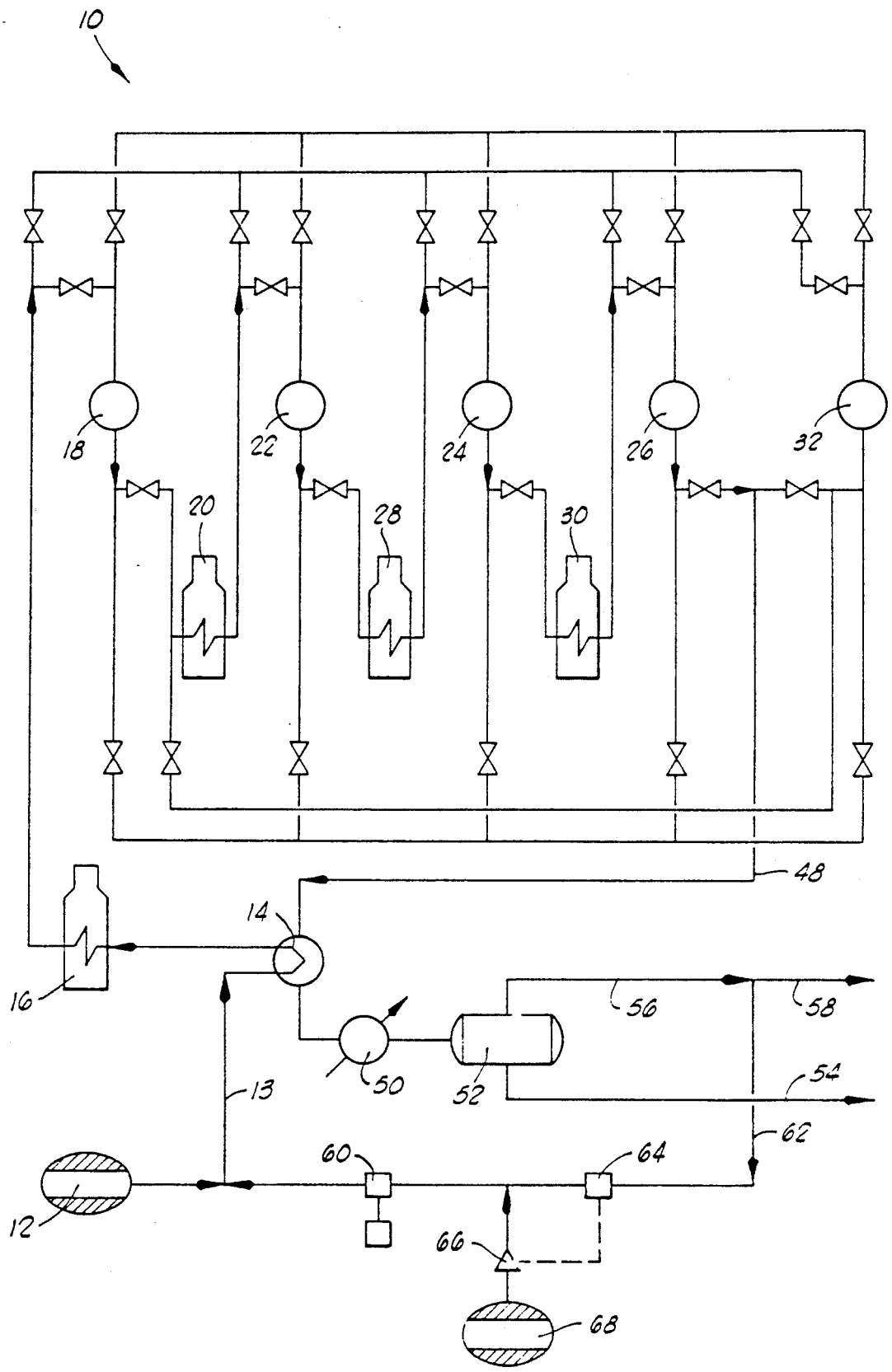
FIG. 1 shows a flow schematic of a reforming process utilizing the reformer optimization system of the present invention.

Referring now to the drawings, and more particularly to FIG. 1, one embodiment of a reformer system including the reformer optimization of the present invention is generally schematically shown and generally designated by the numeral 10. It should be understood that reformer system 10 is one of many such reformer systems, and the invention is not intended to be limited to the particular configuration illustrated.

The process begins with a naphtha feed 12 which is a naphtha fraction boiling in the 80 to 230 C. range. Feed 12 passes via a feed line 13 through a heat exchanger 14 into a preheater 16.

From preheater 16, the feed enters a first catalytic reactor 18 after which it is reheated in a first reheater 20. Since the reactions are endothermic, a number of reactors may be used in series as necessary, with the stream of reactants reheated in between. For example, after first reactor 18 and first reheater 20 are second, third and fourth reactors 22, 24 and 26, respectively. Second and third reactors 22 and 24 are followed by second and third reheaters 28 and 30, respectively. A swing reactor 32 may be provided as needed.

The products are discharged from the reactor-reheater system through line 48 and pass through heat exchanger 14. The products are then cooled in cooler 50 and fed into flash or separator drum 52. The condensed hydrocarbons are withdrawn from flash drum 52 through line 54 as product reformate to a stabilizer.

High hydrogen gases are taken from separator drum 52 through a line 56. High hydrogen purity tail gas for hydrogen services are taken from the system through line 58. Hydrogen recycle gases are fed into a hydrogen recycled gas compressor 60 through a line 62. The compressed gases discharged from compressor 60 are then mixed with feed 12 in feed line 13.

The system as described to this point is of a kind generally known in the art. The improvement of the present invention comprises means for injecting a small amount of non-reactive gas into the hydrogen recycle gas fed to compressor 60. A monitoring means 64 is used to monitor the specific gravity of the recycle gas. Monitoring means 64 may include control means for controlling a valve 66 to control the amount of non-reactive gas from a gas feed 68 into line 62 and thus into the inlet of compressor 60. Monitoring means 64 may take the form of a conventional orifice meter and controller. Of course, manual monitoring and control may also be used.

As will be discussed in more detail herein, the injection of a non-reactive gas such as nitrogen, ethane or propane into the hydrogen recycle gas may be used to maintain a predetermined, constant molecular weight of the gas entering compressor 60. By thus maintaining a substantially constant molecular weight of the compressor inlet gas, an increase in hydrogen circulation is achieved.

Figure 2A:
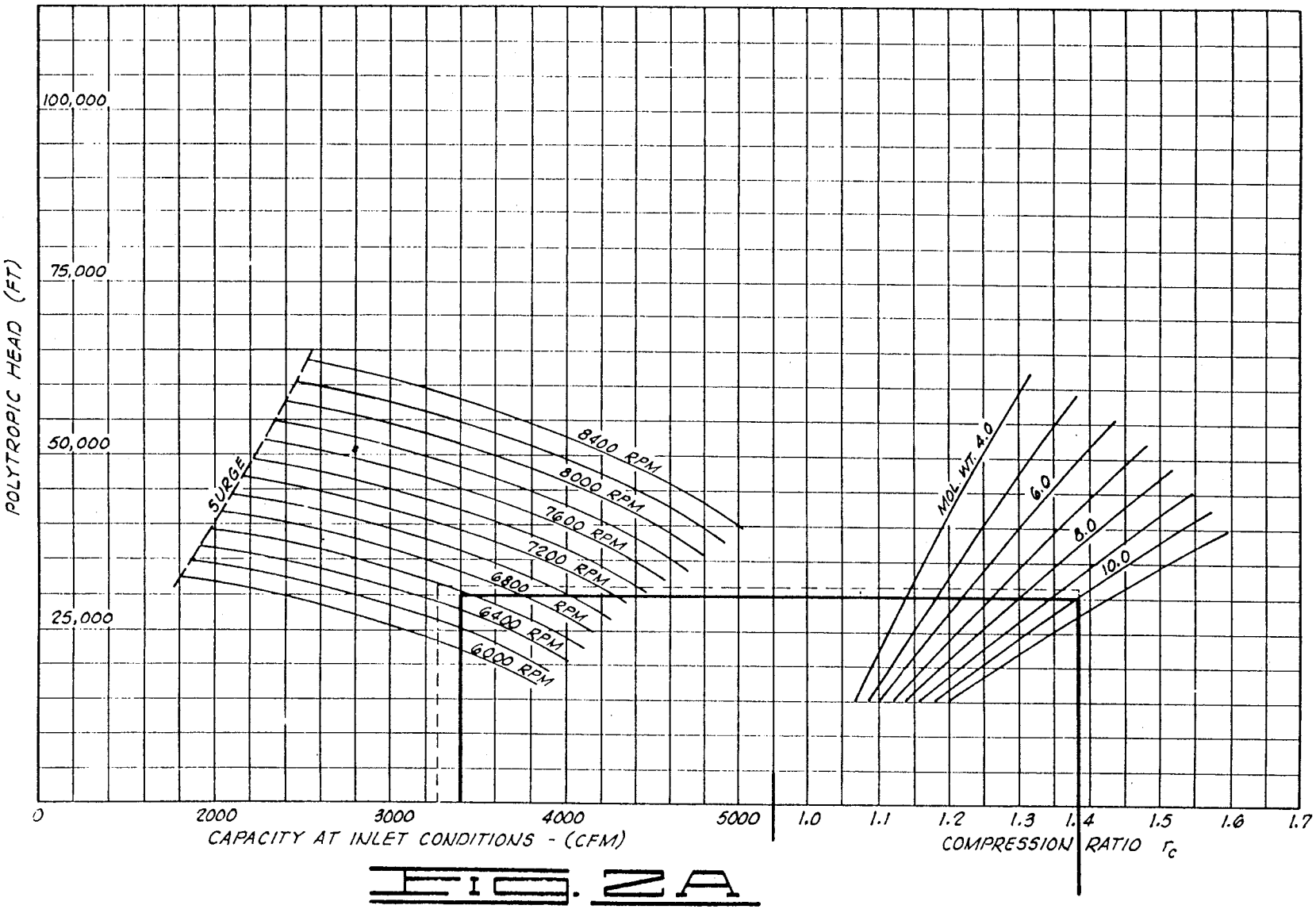
FIGS. 2A and 2B show a centrifugal compressor performance curve illustrating how the method of the present invention increases hydrogen recycled through the compressor.
Figure 2B:
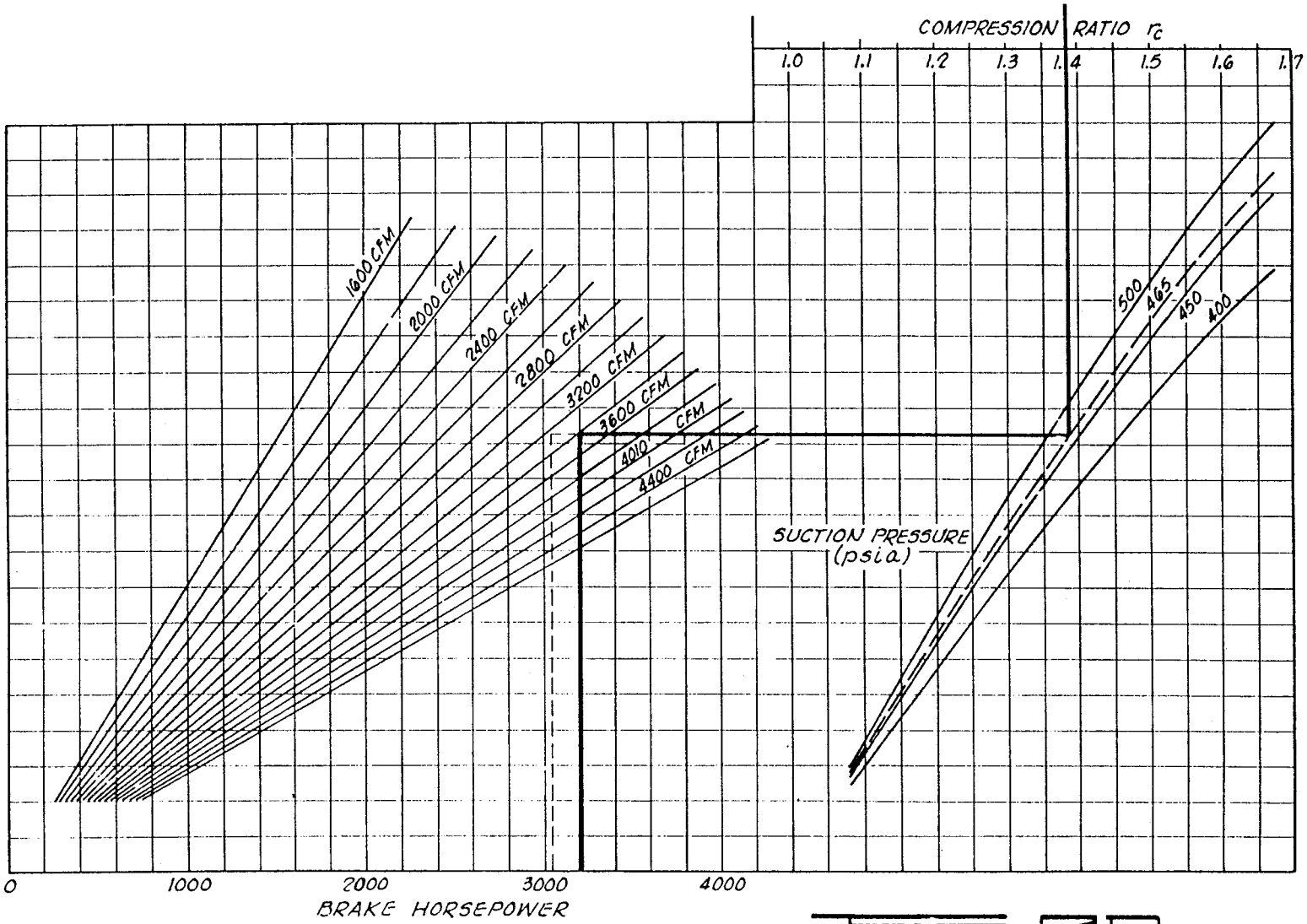

Compressor 60 is preferably a centrifugal compressor of a kind known in the art. The performance of centrifugal compressors is such that the capacity will vary directly with the speed, the head developed as the square of the speed, and the required horsepower as the cube of the speed. FIGS. 2A and 2B show a typical centrifugal compressor performance curve based on these principles.

EXAMPLE 1

Assuming that the design operating conditions are as follows:

| | |
|---|---|
| Speed equals | 6560 rpm |
| Molecular weight equals | 9.6 |
| Inlet or suction pressure equals | 465 psia |
| Outlet or Discharge pressure equals | 645 psia |
| Capacity equals | 3270 cfm |

These conditions are illustrated by the dashed line in FIG. 2A. At the intersection of the compression ratio line and the 9.6 molecular weight line, the dashed line is drawn to intersect 6560 rpm. Extending downwardly with a dashed line, it will be seen that the capacity is 3270 cfm.

By adding 93 cfm of nitrogen to the 3270 cfm of hydrogen-rich recycle gas, the molecular weight will be increased from 9.6 to 10.0. As seen in FIG. 2A, with the compression ratio line held constant, drawing a solid horizontal line to intersect 6560 rpm, and extending downwardly with a solid vertical line, it will be seen that the capacity at the inlet conditions is increased from 3270 to 3400 cfm. This is an actual increase of 130 cfm from the original conditions.

Because only 93 cfm of nitrogen was added, there is a 37 cfm increase in hydrogen flowing through the compressor. This translates to a 1.1% hydrogen increase over the previous capacity when the molecular weight was 9.6.

Thus, a desirable increase in hydrogen rate through the recycle compressor is achieved.

The power requirement is found in FIG. 2B by extending the compression ratio line down to the correct suction pressure line. A horizontal line is drawn to the correct capacity line, then down to find the horsepower required. Again, the original conditions are shown with a dashed line, and the modified conditions with the increased nitrogen shown in solid lines. Where the two overlap, only a solid line is shown. In FIG. 2B, the correct suction pressure line, namely 465 psia, is also shown in dashed lines for clarity so that it is distinguished from the other suction pressure lines.

EXAMPLE 2

In another example, assume that the recycle gas has the following components:

| Gas | Mole Percent |
|---|---|
| $H_2$ | 80.1 |
| $N_2$ | 0 |
| $C_1$ | 10.3 |
| $C_2$ | 4.8 |
| $C_3$ | 3.5 |
| $C_4$ | 0.9 |
| $C_5$ | 0.4 |
| Mol. Weight | 7.07 |

In this example, the recycle rate is 105 MMSCFD with a hydrogen circulating rate of 84 MMSCFD. With a typical charge stock feed rate of 15,500 bbls/day, the ratio of recycle hydrogen-to-liquid hydrocarbon feed is 5 moles per mole. In this case, the catalyst deactivation is 1.65 relative to some predefined base case of 1.0.

By injecting nitrogen such that the components of the recycle gas are as follows, the hydrogen circulation rate may be increased:

| Gas | Mole Percent |
|---|---|
| $H_2$ | 76.3 |
| $N_2$ | 4.7 |
| $C_1$ | 9.8 |
| $C_2$ | 4.6 |
| $C_3$ | 3.3 |
| $C_4$ | 0.9 |
| $C_5$ | 0.4 |
| Mol. Weight | 8.08 |

In this case, the recycle rate is 144 MMSCFD with a hydrogen circulation rate of 110 MMSCFD. This results in a hydrogen-to-hydrocarbon ratio of 6.5 moles per mole. The molecular weight in this case is increased to 8.08 from 7.07.

The increase in hydrogen circulation rate results in a catalyst deactivation of 1.1. Thus, the catalyst life is increased correspondingly which, of course, is an extremely desirable result.

Thus, a study of FIG. 2A will show that by increasing the molecular weight of the gas to the compressor, and maintaining a constant compression ratio, that is, constant inlet and outlet pressure conditions, and a constant speed, the capacity of the compressor is increased more than the actual amount of nitrogen or other gas injected into the hydrogen-rich gas stream. The result is that more hydrogenrich gas will be drawn through line 62 from separator drum 52, and the benefit is increased catalyst life.

It will be seen, therefore, that the reformer optimization for head limited recycle system of the present invention is well adapted to carry out the ends and advantages mentioned as well as those inherent therein. While one preferred embodiment of a reformer system utilizing the method of the present invention has been shown for the purposes of this disclosure, numerous changes in the arrangement and construction of the system components may be made by those skilled in the art. Further, the method may be used with other reformer systems. All such changes are encompassed within the scope and spirit of the appended claims.

What is claimed is:

1. A method of increasing hydrogen flow through a compressor used in recycling hydrogen to a catalytic reforming reactor, said method comprising the steps of:

feeding a stream of hydrogen to said compressor, said stream of hydrogen being discharged from said reforming reactor;

injecting non-reactive gas into the hydrogen stream to define a combined stream, thereby controlling the molecular weight of said combined stream to increase the hydrogen flow through said compressor; and discharging said combined stream and non-reactive gas from said compressor into an inlet of said catalytic reforming reactor.

2. The method of claim 1 further comprising monitoring the specific gravity of said stream of hydrogen on an upstream side of said compressor.

3. The method of claim 2 wherein said monitoring occurs prior to said injecting of said non-reactive gas.

4. The method of claim 2 wherein said step of injecting non-reactive gas comprises maintaining substantially constant the molecular weight of said combined stream.

5. The method of claim 1 further comprising the step of selecting said non-reactive gas from the group consisting of nitrogen, ethane and propane.

6. The method of claim 1 wherein the flow rate of said non-reactive gas injected is relatively smaller than the flow rate of hydrogen in said combined stream.

7. In a catalytic reformer system having a catalytic reactor and centrifugal compressor for recycling a hydrogen stream from an outlet of said compressor to an inlet of said catalytic reactor, the improvement comprising injecting non-reactive gas into the hydrogen stream being recycled for controlling and maintaining a substantially constant molecular weight of the hydrogen and non-reactive gas mixture and thereby increasing a capacity of said compressor resulting in an increased amount of recycled hydrogen into said catalytic reactor.

8. The improvement of claim 7 wherein said injecting of said non-reactive gas in controlled in response to the specific gravity of said hydrogen stream.

9. The improvement of claim 7 wherein the flow rate of said non-reactive gas is relatively smaller than the flow rate of said hydrogen stream.

10. The improvement of claim 7 wherein said nonreactive gas is nitrogen.

11. The improvement of claim 7 wherein said nonreactive gas is ethane.

12. The improvement of claim 7 wherein said nonreactive gas is propane.

* * * * *

UNITED STATES PATENT AND TRADEMARK OFFICE

CERTIFICATE OF CORRECTION

PATENT NO. : 5,015,587

DATED : May 14, 1991

INVENTOR(S) : Gary R. Patton

It is certified that error appears in the above-identified patent and that said Letters Patent is hereby corrected as shown below:

Column 1, line 61, after "this", delete the comma.

Column 5, line 32, delete "hydrogenrich" and insert --hydrogen-rich-- therefor.

Column 6, line 39, delete "in", first occurrence, and insert --is-- therefor.

Signed and Sealed this

Sixth Day of October, 1992

*Attest:*

DOUGLAS B. COMER

*Attesting Officer*

*Acting Commissioner of Patents and Trademarks*